United States Patent [19]

Hendershot

[11] 4,436,275

[45] Mar. 13, 1984

[54] CONCRETE FORM EXTENDER DEVICE

[76] Inventor: Gary L. Hendershot, 7164 Groveland Rd., Holly, Mich. 48442

[21] Appl. No.: 361,559

[22] Filed: Mar. 25, 1982

[51] Int. Cl.[3] ..... E04G 11/06

[52] U.S. Cl. ..... 249/47; 249/44; 249/192; 425/63

[58] Field of Search ..... 249/195, 192, 25, 45, 249/47, 191, 44; 425/63, DIG. 241

[56] References Cited

U.S. PATENT DOCUMENTS 775,685 11/1904 Shute et al. ..... 249/44

3,199,828 8/1965 Newton ..... 249/191

3,236,490 2/1966 Lovgren ..... 249/47

3,767,158 10/1973 Mikus ..... 249/192

*Primary Examiner*—Donald E. Czaja

*Assistant Examiner*—Mary A. Becker

*Attorney, Agent, or Firm*—Harry R. Dumont

[57] ABSTRACT

An extender device for fastening one concrete form size on top of another and holding the two in tight secure relationship. The device used for extending includes a pair of scaffold bolts to permit attachment of a scaffold. It further includes a "U" shaped sharpened slot portion at each end.

6 Claims, 5 Drawing Figures

CONCRETE FORM EXTENDER DEVICE

BACKGROUND OF THE INVENTION

This invention relates to concrete form systems which are constructed from a series of end and side abutting panels such as sheets of plywood maintained in spaced relationship by tie members which extend between and through the plywood sheets and held on their outer ends by suitable hardware. The invention is concerned with providing improved extender devices which can be used to connect either standard or non-standard size concrete forms one on top of the other to give the desired structural height.

It is particularly adaptable for use with those forms that are standardized with respect to their being made of wood with spaced reinforcement metal straps about 16 inches on center extending across each of the forms. Stacking is facilitated by the use of extender devices which reach between upper and lower metal reinforcement straps on the forms to hold them in their stacked positions.

SUMMARY OF THE PRESENT INVENTION

The extender device according to the present invention is a steel or cast metal plate having a slot at both ends operable to engage scaffold bolts which are normally affixed to the reinforcement straps on adjacent forms. The extender device is used for height extension and includes a tapered inner portion on each slot to facilitate fitting of the extender over the mating scaffold bolts and into locking relationship. A problem exists with respect to concrete spills which tend to accumulate around the scaffold bolts. The tapered slot portion when it is fitted into place actually clears off any deposit or accmulation of concrete and permits locking of the forms one over the other. The extender device itself also carries a pair of scaffold bolts which extend outwardly from the forms to permit attachment of any scaffolds required during erection. To further lend rigidity to the assembly, there is an inset portion near the upper and lower ends of each extender device which overlaps the spaced metal straps while an intermediate portion is maintained in firm and solid abutment with the faces of both the two forms being held together.

BRIEF DESCRIPTION OF THE DRAWINGS

The present invention will now be described with reference to the accompanying specification and to the drawings in which like numerals refer to like parts in the several drawings and in which.

DETAILED DESCRIPTION OF THE PREFERRED EMBODIMENT

Figure 1:
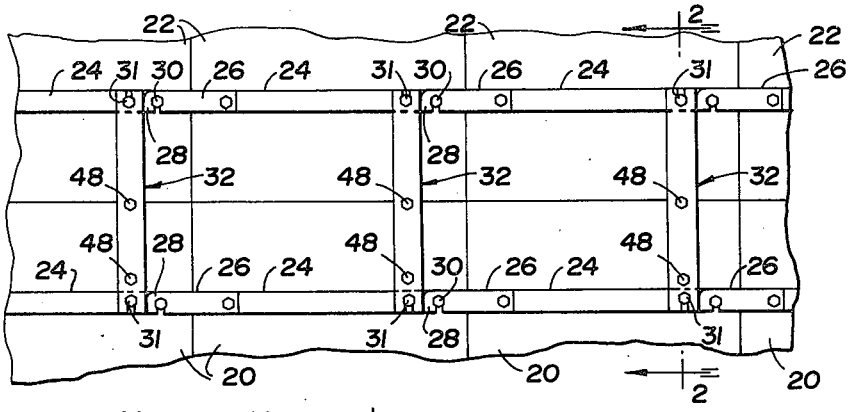
FIG. 1 is a fragmentary front elevational view showing a plurality of concrete forms held together by the extender devices.
Figure 2:
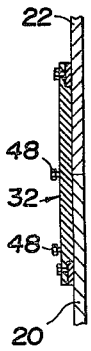
FIG. 2 is a cross-sectional view taken along section lines 2—2 of FIG. 1 with parts broken away, illustrating the extender device in place with the forms and their parts.

FIG. 1 shows a plurality of forms 20 joined in end to end relationship to form a concrete retaining form. It will be understood that FIG. 1 shows one face of a concrete form assembly which also, as well known in the art, includes a second form with the two containing between them the concrete which is poured in a semi-liquid state between the form for hardening in place. In the interest of brevity and simplicity the invention is being illustrated in conjection with one face of the concrete form and its panel.

A second plurality of forms 22 are mounted in tight holding relationship to the upper edges of the panels 20 as indicated. Each of the forms 20, 22 is constructed of wood or plywood and includes a reinforcing strap 24 extending laterally across its surface. Adjacent forms 20, 22 are assembled in respective lines in end to end relationship by a plurality of pivotal locking devices 26 as shown. Each locking device 26 is pivotal about its right hand end and includes a left hand hooked end 28 which engages a bolt head 30 extending outwardly from the metal strap 24 of the next adjacent form 20, 22. Each form 20 or 22 includes at least one inwardly projecting scaffold bolt 31.

The extender devices 32 are shown in their locking positions relative to adjacent upper and lower forms 20, 22 between their respective scaffold bolts 31. The device makes possible a stacking of different size concrete forms, for example, eight feet on eight feet or two feet on eight feet according to the custom height requirement of the job.

Figure 3:
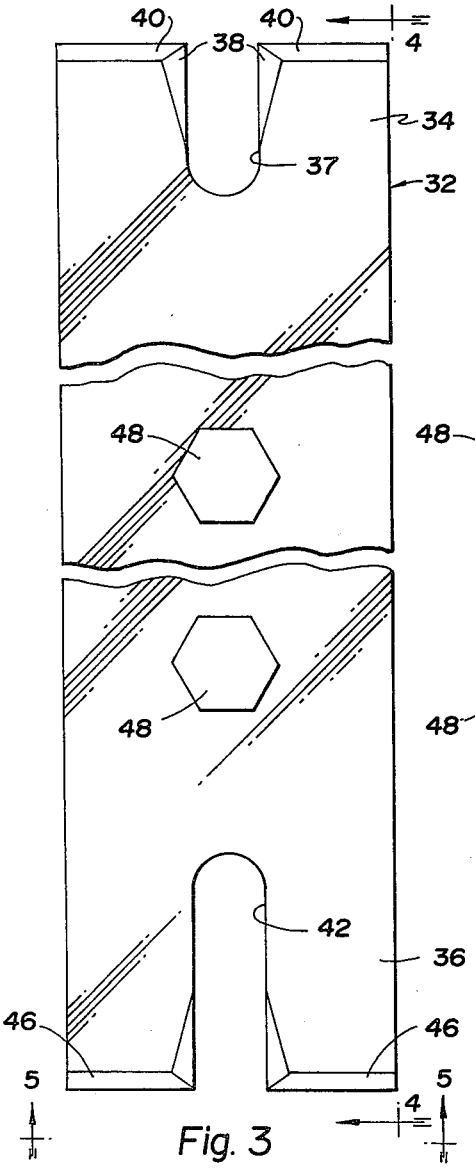
FIG. 3 is a fragmentary front elevational view to enlarged scale showing the detail of one of the extender devices.
Figure 4:
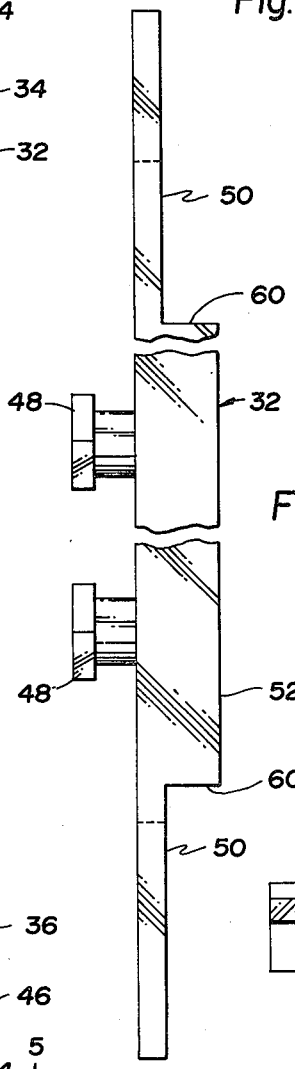
FIG. 4 is a side elevational view of the device of FIG. 3 likewise with parts broken away.
Figure 5:
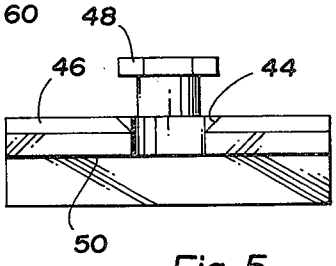
FIG. 5 is a bottom plan view showing further detail of the construction of the device of FIG. 3.

Each extender device 32 as best shown in FIGS. 3 and 4 includes an upper forked end 34 and a lower forked end 36. The upper forked end 34 includes a central "U" shaped slot 37. A tapered surface is preformed by grinding or other like process and shown by the numeral 38. Also a bevel end portion 40 is included at the upper end of the extender device 32. A similar "U" shaped slot 42 is included at the lower end 36 of each extender device 32 which slot is somewhat longer than the slot 37 at the upper end. Similar tapered portions 44 are included at the outer end of the slot 42. Bevel end portions 46 are included in a like manner to the bevel end portions 40 at the top of the extender device 32. A pair of spaced scaffold bolt heads 48 extend from the outer surface of the extender device 32 to permit attachment of scaffolds or similar structures.

As best shown in FIG. 4 an offset portion 50 is included at the top and bottom of each extender device 32 to provide overlap of the associated metal strap 24 against which is abuts. Abutments 60 are provided at the upper and lower ends of the extender device 32 to supportably engage opposed straps 24. The inner central portion 52 of each extender device 32 however extends into tight holding engagement with the flat faces of both upper and lower adjacent froms 22, 20 to assist in forming a single rigid assembly of the forms.

It will thus be seen that I have provided by my invention a greatly improved extender device by which the form parts used are held in a strong, unitary assembly. The extender devices themselves are shaped and fabricated to allow ready assembly of the parts and also to provide for the necessary clean-off of concrete accumulation from the bolts used on the straps of the concrete forms. The resulting assembly is one which may be easily varied and changed with respect to height according to the requirements of the job.

I claim:

1. A concrete form assembly including a plurality of forms arranged in top to bottom relationship, each of such forms including a transverse metal strap including at least one outstanding scaffold bolt, the invention comprising:

a plurality of separate extender devices for holding said forms in assembled top to bottom relationship, each of said extender devices including a slotted upper end and slotted lower end, said slotted ends engaging respective scaffold bolts in tight holding relationship, said slotted ends further including sharpened slot portions and beveled end portions to facilitate assembly and clean-off of said bolts, said extender devices each including a pair of off-set portions proximate each of its end portions and adjacent to and abutting the corresponding straps, said extender portions further including a flat portion intermediate said off-set portions and in firm engagement with the forces of the adjacent upper and lower forms.

2. The combination as set forth in claim 1 wherein said lower "U" shaped slot is substantially longer than the corresponding upper "U" shaped slot.

3. The combination as set forth in claim 1 in which each of said extender devices includes a raised central portion in abutment with the flat surface of adjacent upper and lower forms.

4. The combination as set forth in claim 1 in which a second pair of spaced scaffold bolts are mounted on the outer surface of each of said extender devices.

5. The combination as set forth in claim 1 in which each of said extender devices is fabricated of cast metal.

6. The combination as set forth in claim 1 in which each of said forms is constructed of plywood material.

* * * * *